United States Patent [19]

Nakai et al.

[11] Patent Number: 5,036,955

[45] Date of Patent: Aug. 6, 1991

[54] COLUMN VIBRATION SYSTEM FOR A LINEAR MOTOR DRIVEN ELEVATOR

[75] Inventors: Keiichiro Nakai, Tokyo; Manabu Suganuma, Narita, both of Japan

[73] Assignee: Otis Elevator Company

[21] Appl. No.: 493,576

[22] Filed: Feb. 26, 1990

[30] Foreign Application Priority Data

Feb. 28, 1989 [JP] Japan ..... 1-49720

[51] Int. Cl.[5] ..... B66B 13/24

[52] U.S. Cl. ..... 187/107

[58] Field of Search ..... 187/107, 112; 318/135

[56] References Cited

U.S. PATENT DOCUMENTS 3,792,759 2/1974 Kirsch ..... 187/107
4,011,928 3/1977 Spear et al. ..... 187/107
4,402,386 9/1983 Ficheux et al. ..... 187/112
4,809,817 3/1989 Kawai ..... 187/107

*Primary Examiner*—A. D. Pellinen
*Assistant Examiner*—W. E. Duncanson, Jr.
*Attorney, Agent, or Firm*—Lloyd D. Doigan

[57] ABSTRACT

A column vibration detection system for a linear motor driven elevator system comprises a vibration sensor installed on a column portion of a linear motor for detecting vibrations caused by seismic activity in the column portion propagated through the column portion, a first means for comparing an output signal derived from the vibration sensor with an earthquake occurrence determination signal, and a second means for controlling the linear motor of the elevator system on a basis of the occurrence or output of the first means.

10 Claims, 5 Drawing Sheets

FIG.5
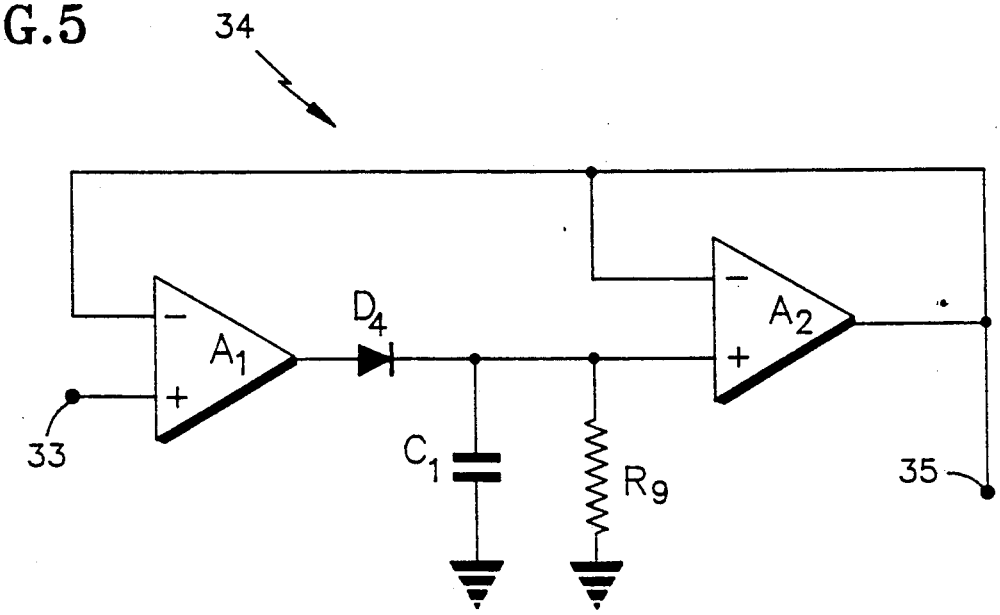
FIG.6 A
FIG.6 B
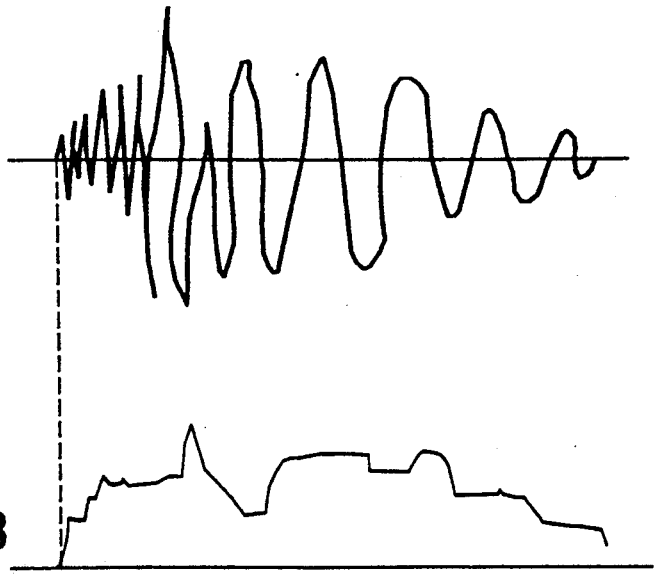

FIG. 7
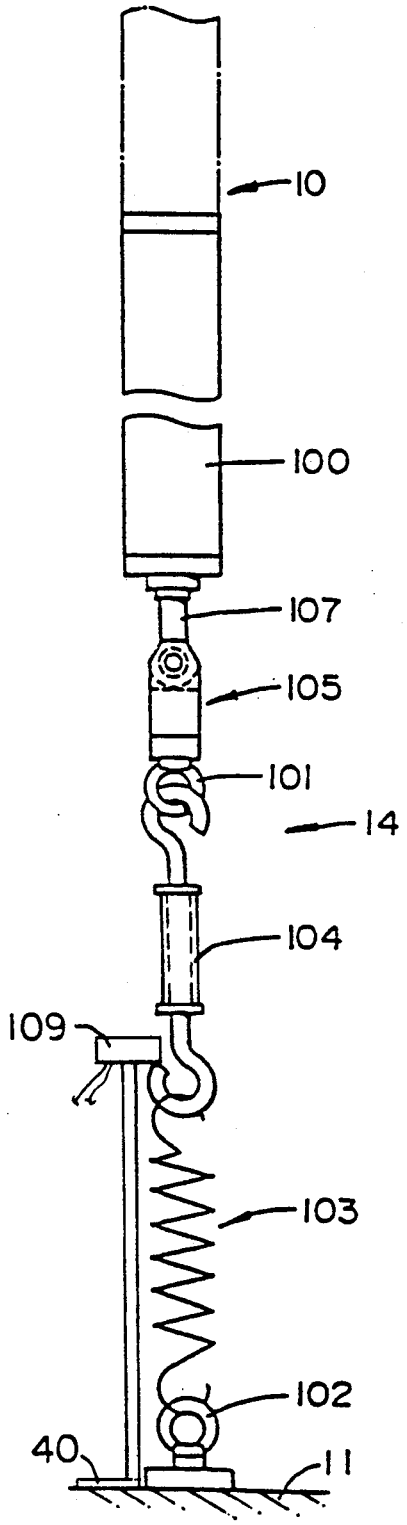
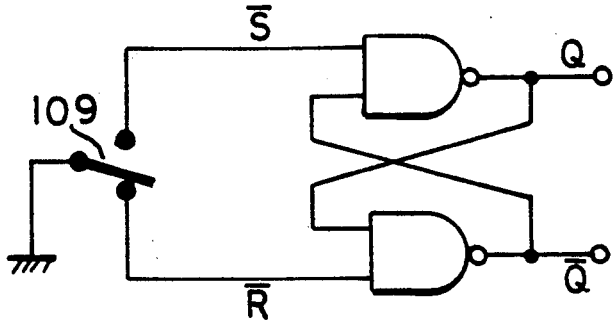
FIG.8

COLUMN VIBRATION SYSTEM FOR A LINEAR MOTOR DRIVEN ELEVATOR

DESCRIPTION

1. Technical Field

This invention relates to elevator systems and more particularly to vibration detection within the column of a linear motor driven elevator system.

2. Background Art

Typically, elevators are driven by traction driving systems. In such systems, an elevator car is supported by a wire rope that is attached, at an end, to an elevator car passed over a drive sheave, and attached, at the other end to a counterweight. The elevator car is raised or lowered through traction developed between the wire rope and the drive sheave, which is rotated by an electric motor. Typically, the drive sheave and the electric motor are installed on top of the elevator in a machine room. The machine room may also house a controller and a braking system for the elevator. As a result, the machine room may take up a large area. In a building where space is at a premium, a large machine room is a major problem. In addition, because of the weight of the equipment in the machine room, the structure of the machine room must be reinforced thereby adding to building costs.

To minimize the weight of the equipment and to maximize the use of space in a building, an elevator system utilizing a linear motor has been developed. Since the linear motor provides motive force by moving with the elevator car or counterweight, drive sheaves and electric motors disposed in a machine room are not required. As a result, the space required by a machine room and the weight of the machine room is minimized.

As in traction driven elevators, the safety of linear motor driven elevators is a major concern particularly when an elevator is installed in a region in which earthquakes are known to occur. When seismic activity occurs, the building and the elevator system swing according to the intensity of the seismic activity. The occurrence of such seismic activity may causes elevator system component failure and malfunction.

DISCLOSURE OF THE INVENTION

It is an object of the invention to provide a stop control mode for a linear elevator system according to the degree of seismic activity.

It is a further object of the invention to provide a detection system which automatically detects vibration of the column portion of a linear motor during the occurrence of an earthquake.

It is a further object of the invention to provide the column vibration detection system which provides a stop/control mode of the elevator system according to the degree of the seismic activity.

According to the invention, a column vibration detection system for a linear motor driven elevator system comprises a vibration sensor installed on a column portion of a linear motor for detecting vibrations caused by seismic activity in the column portion, a first means for comparing an output signal derived from the vibration sensor with an earthquake occurrence determination signal to determine the existence of potentially harmful seismic activity, and a second means for controlling the linear motor of the elevator system on a basis of the occurrence or output of the first means.

These and other objects, features and advantages of the present invention will become more apparent in light of the detailed description of a best mode embodiment thereof, as illustrated in the accompanying drawings.

BRIEF DESCRIPTION OF THE DRAWINGS

FIG. 5 is an internal circuit wiring diagram of a peak hold circuit as shown in FIG. 3, FIGS. *6a* and *6b* are a waveform chart of output signals from the chart amplifier and peak hold circuit of FIG. 5, FIG. 7 is a plan view of a further embodiment of a column vibration detection system of FIG. 1, FIG. 8 is a schematic diagram of a flip-flop circuit used in the control circuit.

BEST MODE FOR CARRYING OUT THE INVENTION

Figure 1:
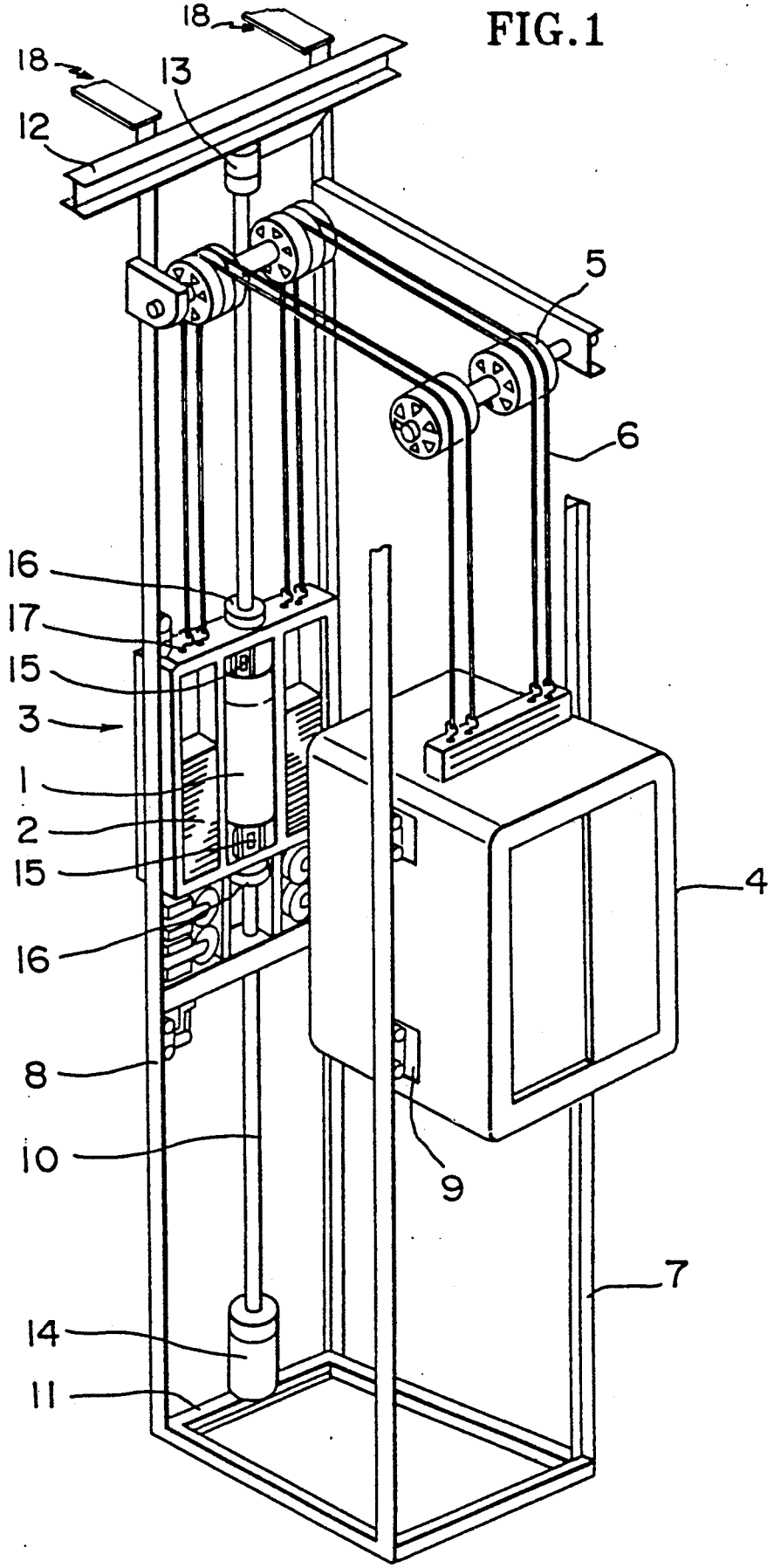
FIG. 1 is a perspective view of an elevator system in which an embodiment of a column vibration detection system according to the present invention is shown, FIGS. *2a* -*2c* are plan views of embodiments of the column vibration detection system of FIG. 1.

Referring to FIG. 1, an elevator system employing a cylindrical linear motor is shown. The cylindrical linear motor includes a moving element 1 and a stationary column 10. An elevator car 4 and a counterweight 3 are linked by four ropes 6 which are guided by idler sheaves 5. The car is disposed between the guide rails 7. The counterweight, which is disposed between guide rails 8, is comprised of a frame 17 and a plurality of weights 2 disposed upon the frame. The moving element, which functions as a primary conductor, is mounted upon the counterweight between the weights. The counterweight usually weights about 1½times as much as the elevator car 4.

A stationary column, which is constructed of an aluminum alloy, functions as a secondary conductor of the linear motor. The column 10 is suspended, via support member 14, to an upper frame member 12. The column is attached, via support member 14 (shown schematically), to a lower frame member 11. It should be noted that the column 10 is constructed of a plurality of rods attached end to end, each rod having a length of 1500 millimeters and a diameter of 100 millimeters for an elevator having a rated load of 600 kilograms. The moving element, as is known in the art, has a through opening for receiving the stationary column therein.

As is well known, an air gap between the primary conductor (the moving element) and the secondary conductor (the column) of the linear motor is desired. The moving element is supported by rollers 15 within the frame 17 to maintain the desired gap at the respective upper and lower portion of the moving element. Gap sensors 16 are mounted on a upper and lower ends of the frame 17 to sense the changes in the gap due to vibration, impacts or wear of rollers 15.

Referring to FIGS. *2a* and *2b*, the structure of the support member 14 is shown. Column 10 may be provided with a extended portion 100 which adjusts the column length. An axle 107, which is rotatable about its length, is attached to the bottom of the column 10. The axle has an opening for receiving a pin 109 for attaching to ball joint 105.

The ball joint 105 has a pair of side yokes 106 which hold a ball 111 therebetween by a pin 113. An eye bolt 101 is attached to a lower portion of the ball. Eye bolt 101 is linked with the eye bolt 102 via coil spring 103 and a turnbuckle 104. The turnbuckle 104 is of well known construction and provides a constant tension upon the column 10 by adjusting a distance between the spring and ball joint. Eye bolt 102 is fixedly attached to the lower frame member 11.

Due to the construction of the ball joint and rotatable axle 107, it is possible to rotate the side yokes through about 360° C. Furthermore, it is possible to rotate the pin 113 through a constant angular width in a plane orthogonal to the rotating plane of the side yokes. Therefore, swings of the column 10 occur in a constant range.

Figure 2A:
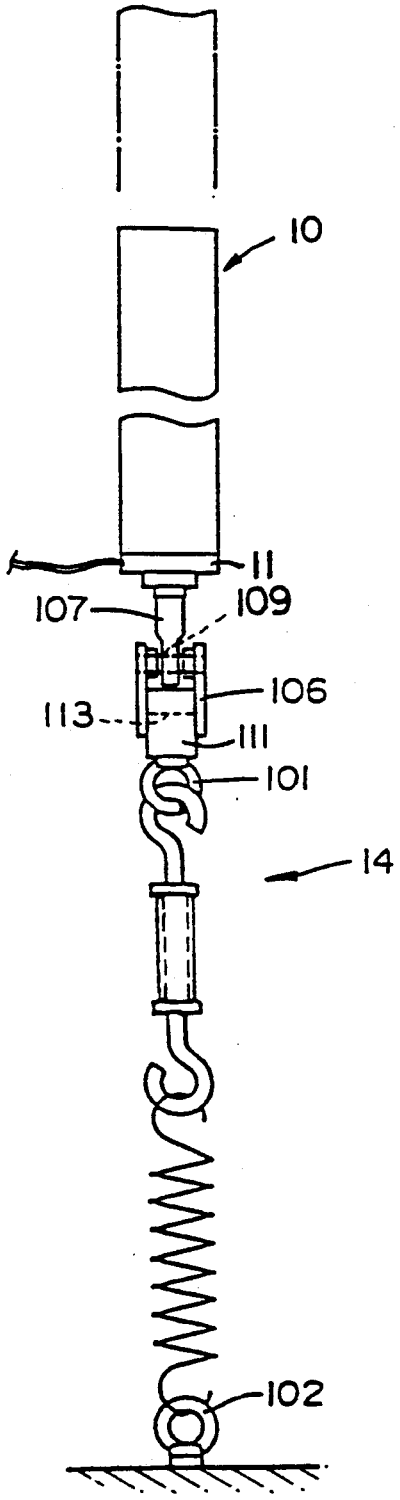
Figure 2B:
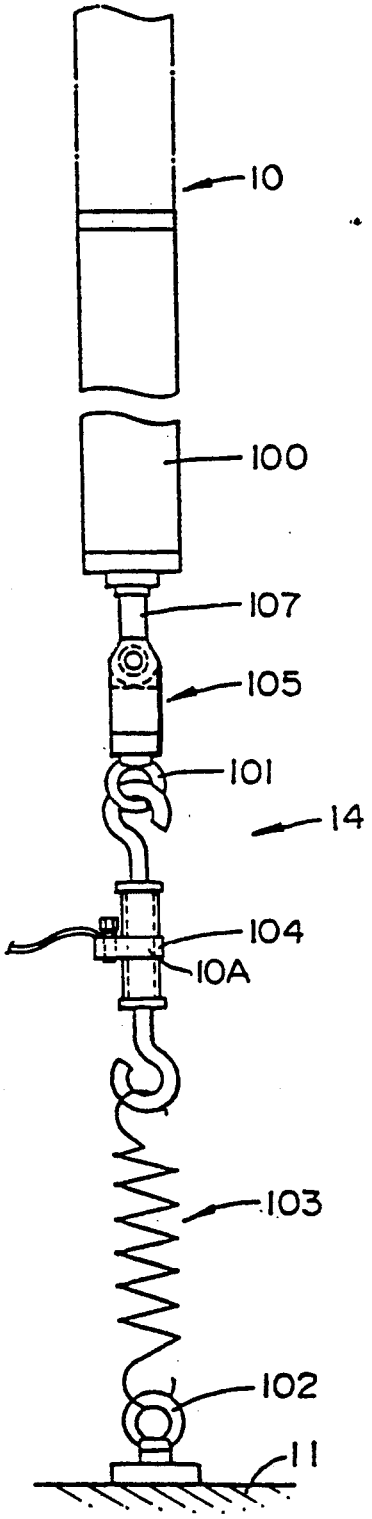
Figure 2C:
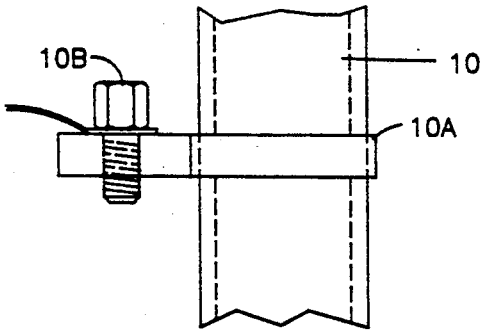

A vibration sensor PZ is disposed at an arbitrary position upon the column so as not to disturb the movement of a counterweight 3. As shown in FIG. 2*a*, a flat-type of vibration sensor PZ is mounted within a bracket 11 between the axle 107 and the column 10 orthogonal to the length of the column. As shown in FIG. 2*b*, a circular bracket 10*a* is mounted upon the turnbuckle 104 orthogonal to the length of the column. Referring to FIG. 2*c*, bracket 10*a* has an extension having an open threaded portion. Bolt 10*b* is screwed into the threaded portion. A vibration sensor PZ is mounted as a washer of the bolt 10*b*. Essentially, the washer-type vibration sensor is mounted at a predetermined position so that cross-sectional plane of the sensor is parallel to an axis passing through the length of the column 10. The sensor must precisely detect vibration in the longitudinal direction of the column. Such a vibration sensor is comprised of pressure change converting element such as a piezoelectric element.

Although seismic waves are propagated in every direction from an epicenter when an earthquake occurs, the wave may be deemed as elastic. The elastic wave includes a P wave in which a state of volume change is transmitted and a S wave in which a state of shear is transmitted without the change of volume. The speeds of the P wave and S wave are $V_P$ and $V_S$ according to the following equation:

$$V_P=(\lambda+2\mu/\rho)^{\frac{1}{2}}$$

$$V_S=(\mu/\rho)^{\frac{1}{2}}$$

In the equation, $\lambda$ and $\mu$ denote Lame's constants (elastic constants), and $\rho$ denotes density. The P wave is propagated at a higher speed that the S wave. The P wave has a small amplitude and high frequency reaching the earth's surface before the S wave. The S wave reaches the earth's surface shortly after the P wave and has a large amplitude. The time interval from the arrival of the P wave to the arrival of the S wave is called P-S time.

A magnitude is used to represent the scale of the earthquake. The magnitude is determined on a basis of a logarithm of a maximum amplitude of earthquake vibrations at a position about 100 kilometers from the earthquake epicenter. The magnitude is proportional to a logarithm of the total energy dissipated as a seismic wave. On the other hand, seismic intensity represents the intensity of the earth's vibrations at a given location. In this embodiment, the degree of the earthquake is represented on the basis of seismic intensity. When a seismic wave propagates to the column 10, the vibration sensor PZ detects the wave and generates an electric charge according to an amplitude of the wave. It should be noted that although the above described spring absorbs vibrations of the column, it is intended as an attenuation damper and is not intended to suppress the propagation of the seismic wave to the column 10.

Figure 3:
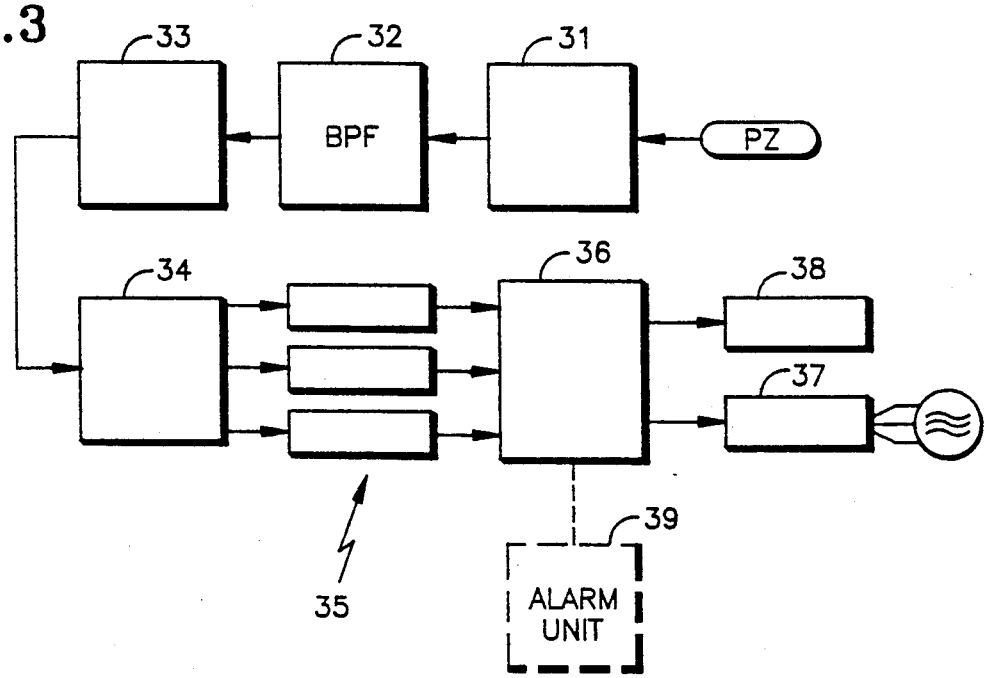
FIG. 3 is a schematic block diagram of an electrical circuit of a control system utilized with FIGS. *2a* and *2b*.
Figure 4:
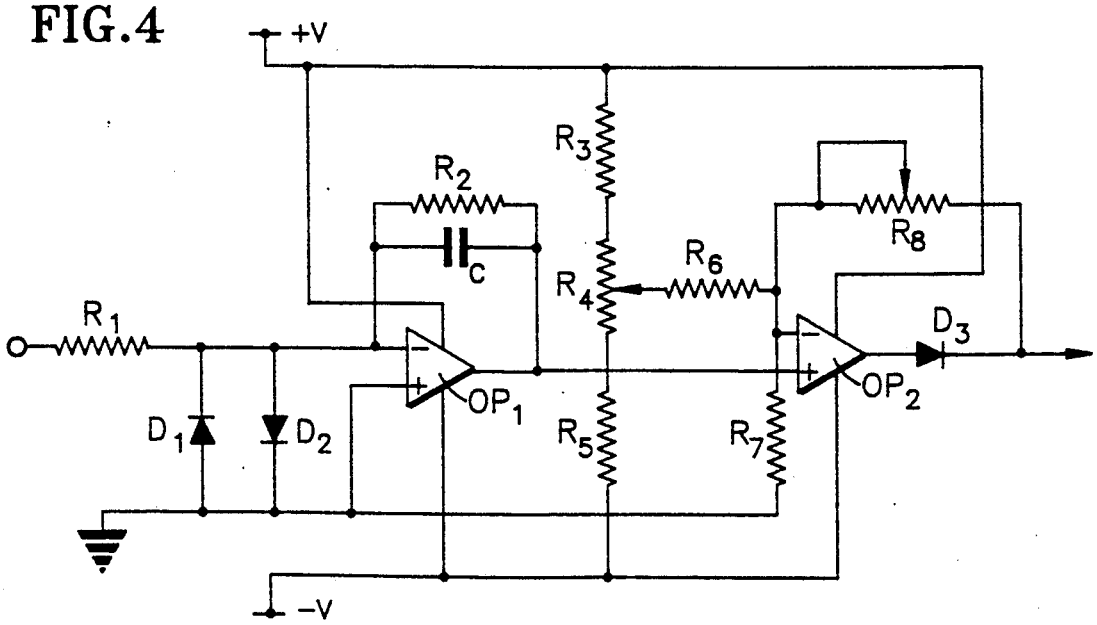
FIG. 4 is a schematic diagram of a charge amplifier as shown in FIG. 3.

Referring now to FIGS. 3, 4, 5, and 6, since the electric charge generated by the vibration sensor PZ is minute, a charge amplifier 31 converts and amplifies the voltage of the vibration sensor and transmits such voltage to Band Pass Filter (BPF) 32. As shown in FIG. 4, the charge amplifier comprises, as one of ordinary skill in the art will readily appreciate, a well known charge-voltage conversion amplifier including resistors R1 to R8, capacitor C, diodes D1–D3 and operational amplifiers OP1 and OP2.

Vibrations occur in the column due to other causes besides earthquake, such as movement of the counterweight. Such vibrations generally have small amplitudes and low frequencies. The background vibration component is limited by means of the BPF which only passes a frequency band corresponding to vibrations caused by seismic waves.

As shown in FIG. 3, an output signal (see FIG. 6, line A) from the BPF 32 is supplied to a halfwave rectifier 33. The halfwave rectifier performs a halfwave rectification of the output signal of the BPF and passes an output signal (see FIG. 6, line B) to a peak hold circuit 34 (also called a maximum value holding circuit) in which the maximum value of the amplitude of the halfwave rectified vibration detection signal derived from the BPF is held.

FIG. 5 shows the actual circuit construction of a well known peak hold circuit 34 including a diode T4, a capacitor C1, a resistor R9, and operational amplifiers A1 and A2. In place of the peak hold circuit 32, an envelope detecting circuit may be used to produce an envelope of the halfwave rectified vibration detection signal.

The maximum value hold signal produced by the peak hold circuit 34 is supplied to a plurality of comparators 35*a*, 35*b* and 35*c*. The comparators 35 compare the maximum value hold signal with three different reference voltages. As the earthquake progresses, the amplitudes of the first P wave (longitudinal wave) are small and periods thereof are short. As the S waves occur, the amplitudes of the maximum value hold signal become abruptly large. Hence, a high reference voltage is set in comparator 35*a* according to a high seismic intensity of the earthquake, an intermediate reference voltage corresponding to an intermediate seismic intensity set in comparator 35*b*, and a low reference voltage corresponding to a low seismic intensity set in comparator 35*c*. A hysteresis control (not shown) may be provided in the comparators. A control unit 36 receives a comparison determination signal from the comparators to make an appropriate determination.

In a case where all comparison determination signals in all comparators indicate high levels, the control unit 36 determines that a strong earthquake having a seismic intensity equal to or higher than, for example, 4 (equal to or more than an intermediate seismic activity) has occurred. The control unit executes a predetermined program which simultaneously transmits an emergency stop signal to an inverter 37 which stops the linear motor and a brake signal to a brake apparatus 38 to immediately stop the elevator system. The system then waits for the seismic activity to subside.

The control unit may transmit a signal to an alarm 39 which indicates that an emergency stop of the elevator has occurred. An elevator service person may then inspect the elevator system to make any necessary repairs.

In a case where the comparison determination signals for the comparators **35*b* and 35*b* indicate high levels and that comparator 35*a* indicates a low level in the peak hold circuit, the control unit determines that, for instance, a light earthquake having a seismic intensity of 2 or 3 has occurred. The control unit then executes a predetermined program, for example, which transmits a signal to the inverter and brake apparatus 38 to have the car make a brief stop at the closest floor. A signal may also be transmitted to the alarm unit 39**.

Further, in a case where only comparator **35*c* outputs a high level comparison determination signal for a predetermined time, the control unit 36, for example, determines that an earthquake having an intensity of 1 or less has occurred. The control unit executes a predetermined program, for example, which transmits a signal to the inverter and the brake apparatus commanding the car to be moved to the closest floor. The control unit may also transmit a signal to alarm 39**.

As will be appreciated, the predetermined programs executed according to the degree of earthquake (seismic intensity) are not limited to the above-described methods. In a case where only low level signals are outputted from the comparators 35, the control unit determines that no earthquake has occurred and executes normal control of the inverter 37 and brake control of the brake apparatus 38.

Although the column detecting system uses a piezoelectric element, various kinds of vibration sensors such as ceramic vibrators may be used. For example, a permanent magnet may be installed between the spring 103 and the turnbuckle 104. A magnetoelectric converting element, such as a Hall element, is installed adjacent to the permanent magnet so as to detect the change in magnetic field intensity with the vibratory movement of the permanent magnet due to the occurrence of an earthquake. A change in the current derived from the Hall element due to the change in the magnetic field is converted into a voltage change. A voltage comparator is used to determine the occurrence of the earthquake and its intensity as above.

In a further embodiment, as shown in FIG. 7, a pin plunger of a microswitch 109 is installed to abut the turnbuckle 104 installed between the upper eye bolt and the coil spring 103. The microswitch is turned on and off when the turnbuckle is moved relative to the floor due to the occurrence of an earthquake. The on and off switching generating during a given time period may cause a known flip-flop circuit, as shown in FIG. 8, to transmit an "on" signal. During the predetermined time, the control unit 36 receives the "on" signal from the flip-flop circuit and compares the input number of "on" signals with a predetermined number to determine the occurrence of an earthquake. As described in the above-described preferred embodiment, the emergency stop signal and alarm signal are output to the brake apparatus 38, the inverter 37, and the alarm unit 39.

As described hereinabove, since the column vibration detection system for the linear motor driven elevator system automatically detects the occurrence and severity of an earthquake, and executes a program in response thereto, the overall safety of the elevator is enhanced. Furthermore, since the stop/control is changed according to the intensity of the earthquake, appropriate control of an elevator system during the occurrence of the earthquake is achieved.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

We claim:

1. An apparatus for detecting an earthquake in an elevator system, said elevator system being driven by a linear motor having a moving element and a stationary element along which the moving element travels, said apparatus comprising;

a vibration sensor for detecting vibrations in said stationary element, and for generating a first signal indicative of said vibrations, means for comparing said first signal with an earthquake occurrence signal and for generating a second signal relating to said comparison of said first signal and said earthquake occurrence signal, and control means for controlling said elevator in response to the second signal.

2. The apparatus of claim 1 wherein said vibration sensor comprises;

a piezoelectric element.

3. The apparatus of claim 1 wherein said control means further comprises;

means for stopping the elevator system when receiving the second signal from the comparator if said second signal indicates that the amplitude maximum value of the comparator exceeds the predetermined voltage.

4. The apparatus of claim 1 further comprising;

a bracket for mounting said vibration sensor upon a bottom end portion of said stationary element.

5. The apparatus of claim 1 further comprising;

means for flexibly attaching a bottom end portion of said stationary element to ground, a bracket mounted upon said flexible means, said vibration sensor mounted upon said bracket in a plane perpendicular to a longitudinal axis of said stationary element.

6. The apparatus of claim 1 wherein said means for comparison comprises;

a charge amplifier for amplifying said first signal, a band pass filter for passing a portion of said first signal, said portion having a frequency band relating to an earthquake, means for shaping said portion of said first signal, and for producing a maximum amplitude value signal of said portion of said first signal, and a comparator for comparing said amplitude maximum value signal with a predetermined voltage relating to a severity of said earthquake and for generating said second signal.

7. The apparatus of claim 6 wherein said comparator further comprises;

a plurality of comparators, each comparator being set to a voltage corresponding to relative seismic intensity of an earthquake.

8. The apparatus of claim 7 wherein said control means further comprises;

an alarm, means for immediately stopping said elevator system upon receiving a second signal from one of said comparators set to a voltage indicating the occurrence of an earthquake having a high seismic intensity, and for transmitting a signal indicative thereof to said alarm, means for immediately stopping said elevator system upon receiving a second signal from another of said comparators set to a voltage indicating the occurrence of an earthquake having an intermediate seismic intensity, and for transmitting a signal indicative thereof to said alarm, means for briefly stopping said elevator system at a given floor upon receiving a second signal from another of said comparators set to a voltage indicating the occurrence of an earthquake having a low seismic intensity, and for transmitting a signal indicative thereof to said alarm.

9. The apparatus of claim 1 wherein said vibration sensor comprises;

a microswitch for providing first signals comprising "on" signals.

10. The apparatus of claim comprising;

wherein said means for comparison further comprises means for comparing a number of switch "on" signals with a predetermined number relating to seismic activity and, said control means controlling said elevator system upon determining that the number of the "on" signals exceeds the predetermined number thereby indicating the occurrence of the earthquake.

* * * * *

UNITED STATES PATENT AND TRADEMARK OFFICE

CERTIFICATE OF CORRECTION

PATENT NO. : 5,036,955

DATED : August 6, 1991

INVENTOR(S) : Keiichiro Nakai, et al

It is certified that error appears in the above-identified patent and that said Letters Patent is hereby corrected as shown below:

Column 8, line 7, after the word "claim", please insert the numeral --1--.

Signed and Sealed this

Twenty-fourth Day of November, 1992

*Attest:*

DOUGLAS B. COMER

*Attesting Officer*

*Acting Commissioner of Patents and Trademarks*